US007121936B2

(12) United States Patent
Parker

(10) Patent No.: US 7,121,936 B2
(45) Date of Patent: Oct. 17, 2006

(54) GRINDING WHEEL REPLACEMENT FIXTURE

(75) Inventor: Joseph Carson Parker, Howell, MI (US)

(73) Assignee: C & B Machinery Company, Livonia, MI (US)

( * ) Notice: Subject to any disclaimer, the term of this patent is extended or adjusted under 35 U.S.C. 154(b) by 0 days.

(21) Appl. No.: 11/293,949

(22) Filed: Dec. 5, 2005

(65) Prior Publication Data

US 2006/0084372 A1 Apr. 20, 2006

(51) Int. Cl.
*B24B 41/00* (2006.01)

(52) U.S. Cl. ..... 451/442; 451/360; 451/361

(58) Field of Classification Search ..... 451/442, 451/360, 361; 269/71, 17, 289 R
See application file for complete search history.

(56) References Cited

U.S. PATENT DOCUMENTS

| | | | | |
|---|---|---|---|---|
| 3,762,060 | A * | 10/1973 | Hardy | 33/569 |
| 3,889,604 | A * | 6/1975 | Lollis et al. | 104/32.1 |
| 4,715,775 | A * | 12/1987 | Amino | 414/758 |
| 5,725,205 | A * | 3/1998 | O'Berg | 269/37 |
| 6,446,949 | B1 * | 9/2002 | Schmid et al. | 269/71 |

* cited by examiner

*Primary Examiner*—David B. Thomas
*Assistant Examiner*—Robert Scruggs
(74) *Attorney, Agent, or Firm*—Gifford, Krass, Groh, Sprinkle, Anderson & Citkowski, P.C.

(57) ABSTRACT

An apparatus to facilitate the replacement of a grinding wheel secured to a mounting plate. The apparatus includes a frame having two spaced-apart uprights. An elongated support bar extends between and is pivotally mounted to the uprights while a mounting plate of a grinding wheel is detachably secured to the support bar. A lift table is mounted to the frame between the uprights and movable between a raised position in which the lift table is positioned adjacent the support bar and a lowered position in which the lift table is spaced downwardly from the support bar. The lift table is dimensioned to support a grinding wheel. An actuator is mounted to the frame and selectively moves the lift table between its raised and lowered positions.

18 Claims, 7 Drawing Sheets

GRINDING WHEEL REPLACEMENT FIXTURE

BACKGROUND OF THE INVENTION

I. Field of the Invention

The present invention relates generally to a fixture for replacing a grinding wheel on an industrial grinding machine.

II. Description of Related Art

Industrial grinders are used extensively in the manufacturing industry, such as the automotive industry. Such grinding wheels are typically mounted to a mounting plate which in turn is detachably secured to the rotary drive mechanism of the grinding machine.

During a grinding operation, the part to be ground is positioned adjacent the grinding wheel, or more typically in between two grinding wheels, while the grinding wheels are rotatably driven. The grinding wheels are then axially displaced against the part to perform the grinding operation. Upon completion of the grinding operation, the ground finished part is removed. Thereafter, an unfinished part is positioned in between the grinding wheels whereupon the above process is repeated.

The grinding wheels are necessarily consumed or used up during the grinding process. Consequently, after the useful life of the grinding wheel has been exhausted during the manufacturing operation, it is necessary to replace the grinding wheel with a new grinding wheel.

In order to replace the grinding wheel, it has been the previous practice to attach an eyebolt or similar fastener to the mounting plate for the grinding wheel while mounted within the grinding machine. Thereafter, the mounting plate is disconnected or detached from the rotary drive of the grinding machine and removed from the grinding machine by a crane.

Following removal of the spent grinding wheel from the grinding machine, the mounting plate is removed from the grinding wheel, attached to a new grinding wheel by threaded fasteners, and then replaced into the grinding machine by the crane.

The grinding wheels with the mounting plates of the type used in industrial grinding machines are oftentimes three to four feet in diameter and weigh several hundred pounds. Consequently, the previously known method for replacing the grinding wheel oftentimes results in damage to the grinding wheel and/or the mounting plate. Furthermore, workplace injuries can occur to the workers who manually manipulate the grinding wheel while attaching the mounting plate to a new grinding wheel.

SUMMARY OF THE PRESENT INVENTION

The present invention provides an apparatus for facilitating replacement of a grinding wheel on a mounting plate which overcomes all of the above-mentioned disadvantages of the previously known practices.

In brief, the apparatus of the present invention includes a frame having two spaced-apart uprights. An elongated support bar extends between and is pivotally mounted to the tops of the upright supports. A gear mechanism is secured to the frame in order to pivot the support bar about its axis.

A positioning pin is secured to the support bar such that the pin protrudes outwardly from one side of the support bar. This pin is dimensioned to fit within the center opening of a conventional grinding wheel mounting plate in order to position the mounting plate of a grinding wheel on the support bar. A plurality of threaded fasteners then extend through openings in the support bar to temporarily, but firmly, secure the mounting plate of the grinding wheel to the support bar.

A lift table is also mounted to the frame and is movable between a raised position and a lowered position. A roller table is, in turn, mounted on top of the lift table and the roller table is movable within predefined limits relative to the lift table.

An actuator is mounted to the frame and operatively connected to the lift table to move the lift table between the raised position, in which the roller table is positioned closely adjacent the support bar, and a lowered position, in which the lift table and roller table are spaced downwardly from the support bar.

In operation, the lift table is first lowered and the support bar is pivotally mounted so that the locating pin extends generally horizontally. The spent grinding wheel with its mounting plate is then removed by a crane from the grinding machine in the conventional fashion. The mounting plate is then positioned on the support bar so that the locating pin extends through the center bore of the mounting plate. The mounting plate is then secured to the support bar by threaded fasteners and the crane removed.

Thereafter, the support bar is pivoted substantially ninety degrees so that the mounting plate and spent grinding wheel are positioned in a generally horizontal plane and facing downwardly towards the roller table. Thereafter, the actuator moves the lift table to its raised position so that the roller table abuts against the bottom surface of the grinding wheel. The spent grinding wheel is then disconnected from the support bar by unscrewing the fasteners which extend through the mounting plate and into the grinding wheel. When the spent grinding wheel is detached from the mounting plate, the lift table is again lowered and the spent grinding wheel removed from the roller table and discarded.

Thereafter, a new grinding wheel is positioned on the roller table and the actuator is again actuated to move the lift table from its lowered and to its raised position so that the new grinding wheel abuts against the mounting plate. The position of the new grinding wheel is then adjusted by moving the roller table relative to the lift table as necessary in order to align the openings in the mounting plate with the corresponding openings in the new grinding wheel. Thereafter, the new grinding wheel is attached to the mounting plate by the appropriate threaded fasteners.

Following attachment of the new grinding wheel to the mounting plate, the lift table is again moved to its lowered position by the actuator and the support bar is then pivoted so that the grinding wheel is positioned in a generally vertical plane. A crane is then attached to the mounting plate in a conventional fashion, typically by eyebolts. After attachment, the mounting plate is detached from the support bar by unscrewing the fasteners extending through the support bar and into the mounting plate and a new grinding wheel is then reattached to the rotary drive mechanism of the grinding machine in the conventional fashion.

BRIEF DESCRIPTION OF THE DRAWING

A better understanding of the present invention will be had upon reference to the following detailed description, when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
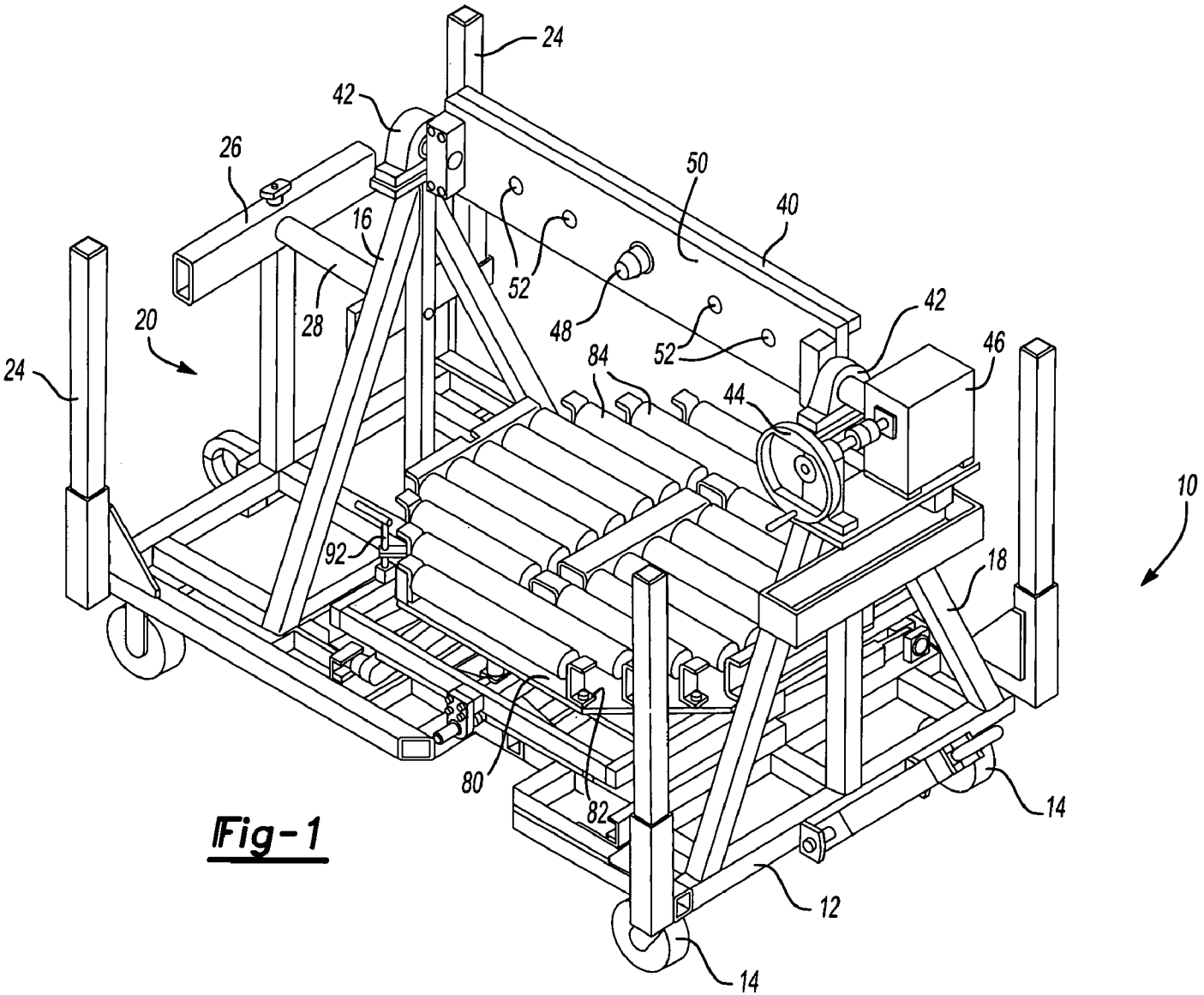
FIG. 1 is an elevational view illustrating a preferred embodiment of the present invention.
Figure 10:
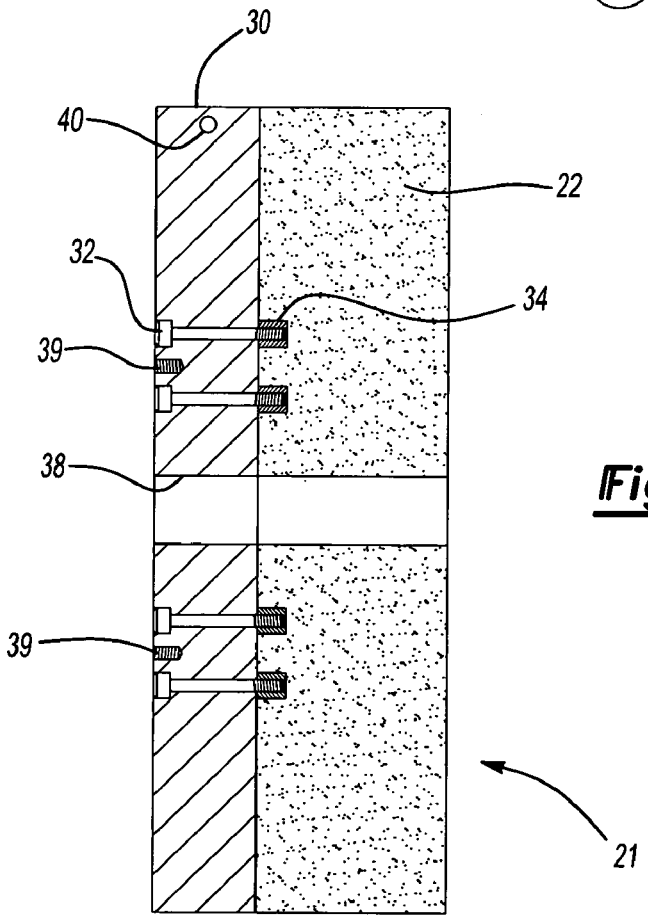
FIG. 10 is a side view of a grinding wheel assembly.

With reference first to FIGS. 1 and 10, a preferred embodiment of the apparatus 10 of the present invention is shown for use with grinding wheel assembly 21 of the type used in industrial grinding machines. The grinding wheel assembly includes a grinding wheel 22, which is mounted to a circular mounting plate 30 by threaded fasteners 32. These threaded fasteners 32 threadably engage nuts 34 which are embedded in one side of the grinding wheel 22 by epoxy or the like. In addition a plurality of threaded bores 39 are open to the back face of the mounting plate for attaching the grinding wheel assembly 21 to the grinding machine.

The mounting plate 30, which is typically constructed of metal, also includes a central through opening 38. In addition, one or more threaded holes 40 are provided around the outer rim of the mounting plate 30. Eyebolts or similar fasteners are then detachably secured to one of these openings 40 to enable the grinding wheel assembly to be moved by a crane once the mounting plate 30 is attached to the grinding wheel 22.

Referring now to FIG. 1, the apparatus includes a frame 12 made of a rigid construction and preferably constructed from metal tubing. A plurality of casters 14 are also mounted to the bottom of the frame 12 so that the frame 12 may be easily rolled along a ground support surface.

The frame 12 further includes a pair of spaced-apart uprights 16 and 18. The uprights 16 and 18 are fixed to the frame 12 and are also preferably constructed of metal tubing for rigid and relatively lightweight construction.

Figure 2:
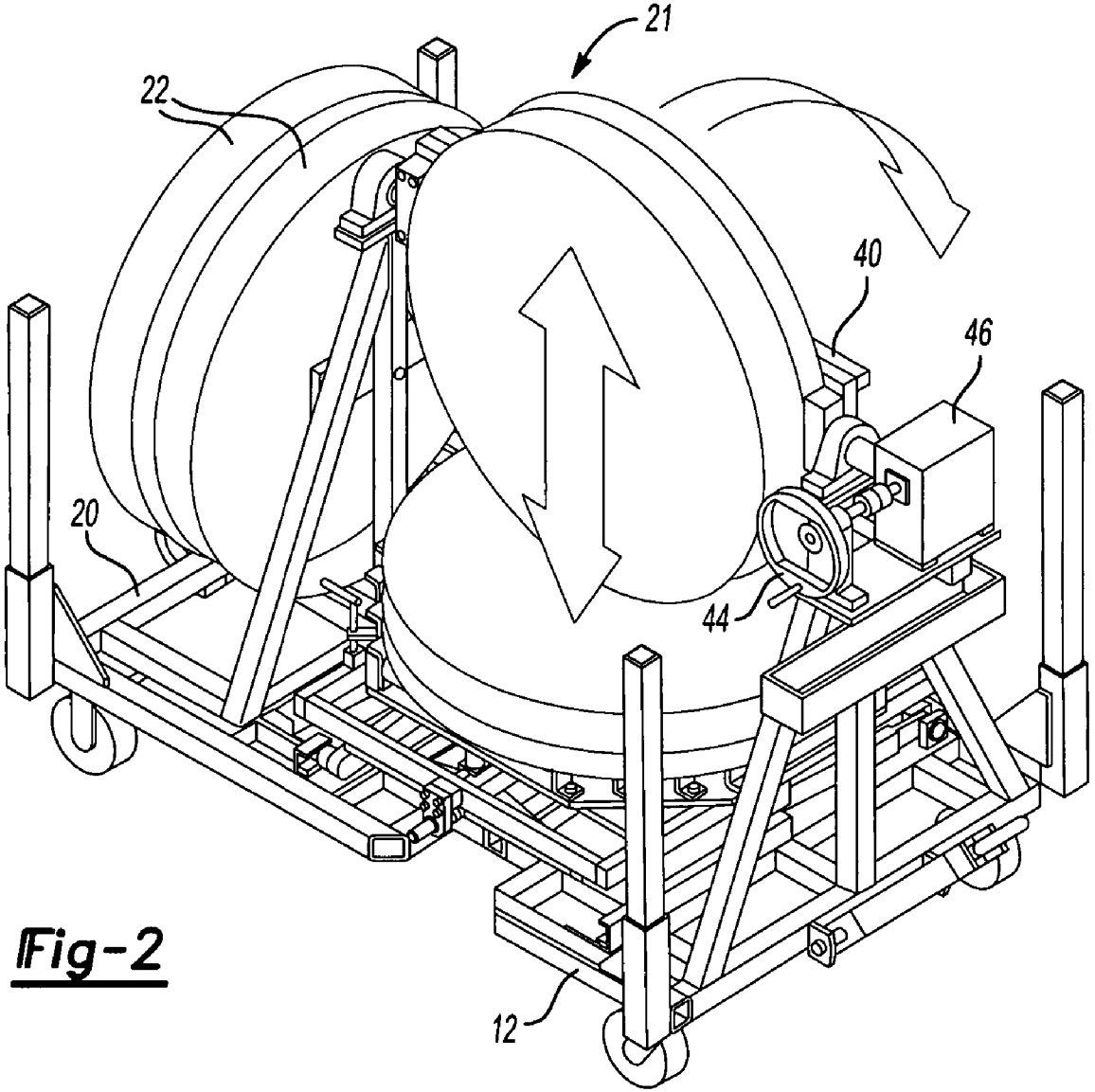
FIG. 2 is a view similar to FIG. 1, but illustrating a portion of the operation of the preferred embodiment of the present invention.

As best shown in FIGS. 1 and 2, a pair of posts 24 extend upwardly from the frame 12 at a position spaced outwardly from the upright support 16. In addition, a grinding wheel holder 26 is positioned in between the posts 24 and includes a horizontally extending member 28 dimensioned to fit through a central opening of a conventional grinding wheel 22.

The area between the posts 24 and the upright support 16 forms a storage area 20 for the storage of new grinding wheels 22. These new grinding wheels 22 are positioned on the holder 28 which removably secures the grinding wheels 22 to the frame 12, but enables their easy removal from the frame 12 when desired. Furthermore, the holding area 20 may be dimensioned to contain one, two or even more spare grinding wheels 22.

An elongated support bar 40 extends across and between the upright supports 18. Each end of the support bar 40 is pivotally mounted to its associated upright supports 16 and 18 by a pillow block 42 so that the support bar 40 is pivotal around at least ninety degrees. A hand crank 44 and gearbox 46 is operatively connected to the support bar 40 to pivot the support bar 40 upon rotation of the crank 44.

As best shown in FIG. 1, a locating pin 48 is secured to and protrudes outwardly from one side 50 of the support bar 40 from its center. This locating pin 48 is dimensioned to fit within the through opening 38 of the mounting plate 30. In addition, a plurality of openings 52 are provided through the support bar 50 for a reason to be subsequently described.

Figure 5:
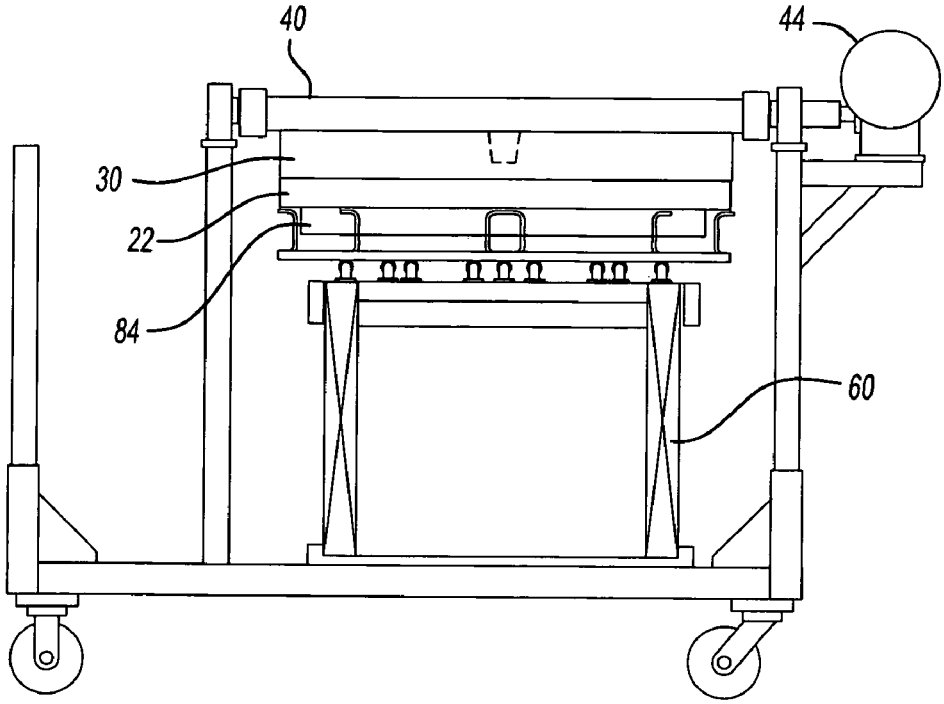
Figure 6:
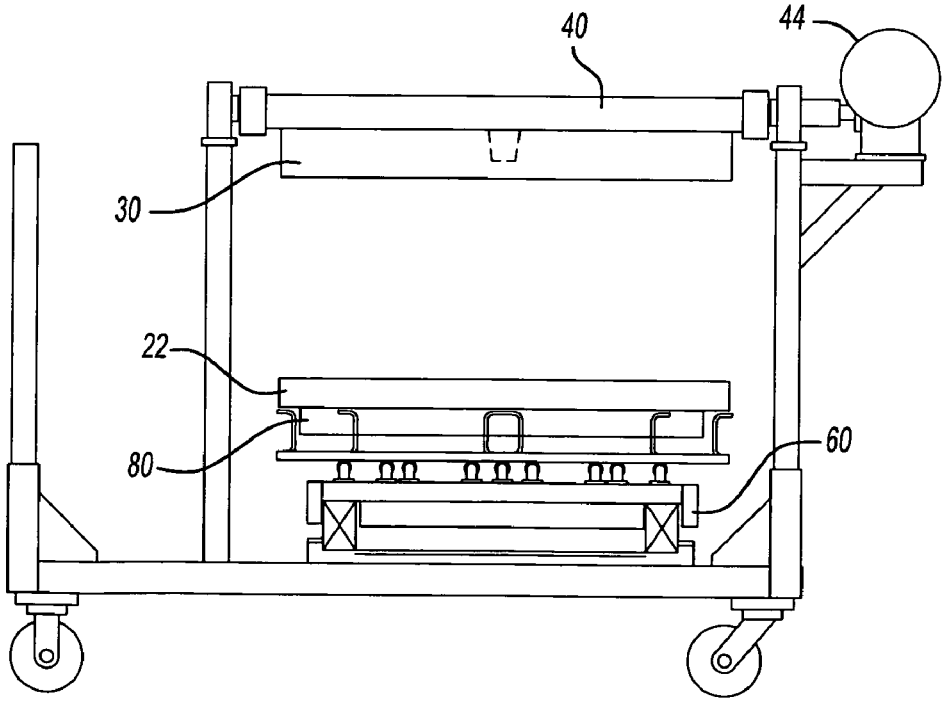

With reference now to FIGS. 1, 5, 6 and 11, a lift table 60 is mounted to the frame 12 and movable between a lowered position, illustrated in FIG. 6, and a raised position, illustrated in FIG. 5. In its lowered position, the lift table 60 is spaced downwardly from the support bar 40. Conversely, in its raised position, the top of the lift table 60 is positioned adjacent the support bar 40.

Figure 11:
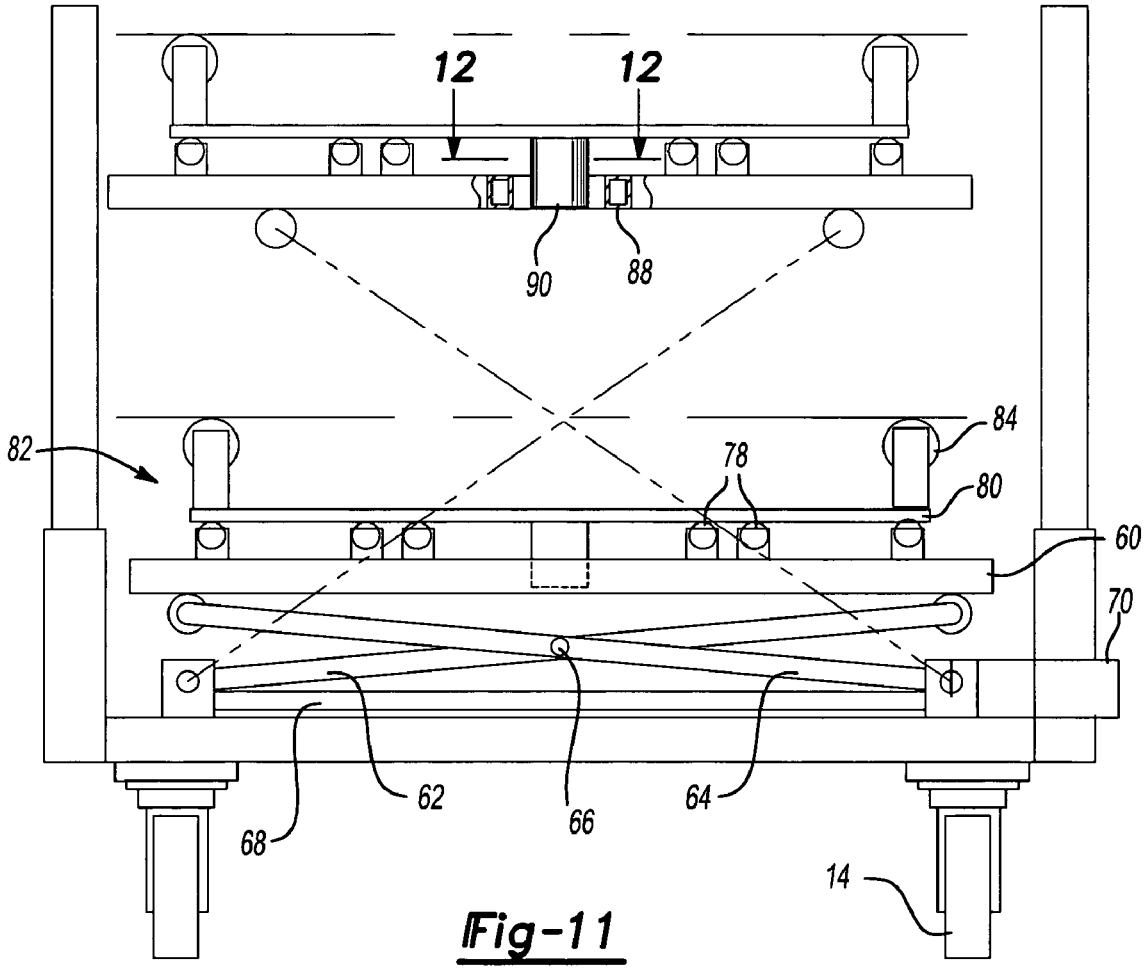
FIG. 11 is a side view of the preferred embodiment.

The lift table 60 may be of any conventional construction. However, as best shown in FIG. 11, it preferably comprises a scissor lift table having scissor supports 62 and 64 which are pivotally secured together by a pivot pin 66 at their midpoint. An actuator rod 68 is threadably attached to one end of the scissor 62 and rotatably mounted to the end of the other scissor 64. Consequently, rotation of the actuator shaft 66 by an actuator 70 causes the lift table 60 to move between its raised and lowered positions depending upon the direction of rotation of the actuator shaft 68. The actuator 70 may be either hand powered or powered by a suitable motor.

With reference still to FIG. 11, a plurality of ball bearing supports 78 are secured to and extend upwardly from atop the lift table 60. A frame 80 of a roller assembly 82 is then supported on top of the ball bearing supports 78 so that the frame 80 is movable along a horizontal plane relative to the lift table 60. A plurality of cylindrical rollers 84, best shown in FIG. 1, are in turn mounted to the roller frame 80.

Figure 12:
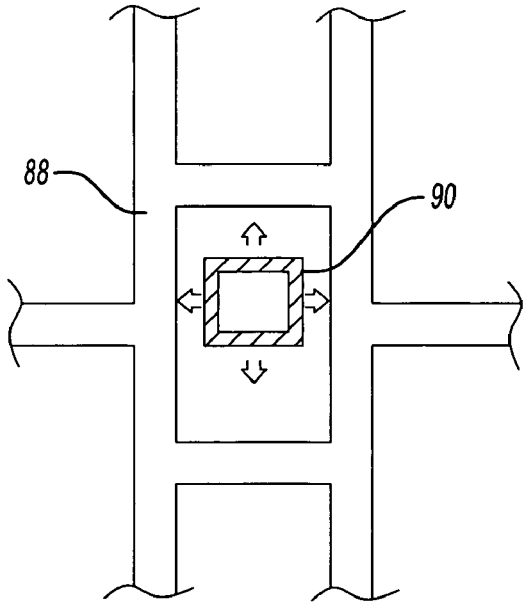
FIG. 12 is a fragmentary sectional view taken along line 12—12 in FIG. 11 and enlarged for clarity.

With reference now particularly to FIGS. 11 and 12, in order to limit the amount of movement of the roller assembly 82 relative to the lift table 60, the lift table 60 includes an enclosure 88 at its top in the center of the lift table 60. The enclosure 88 is illustrated in FIG. 12 as rectangular in shape, but the enclosure 88 may be of any desired shape. A post 90 in turn is secured to and extends downwardly from the roller assembly 80 so that the post 90 is positioned within the interior of the enclosure 88. Consequently, the coaction between the post 90 and the enclosure 88 limits the magnitude of movement of the roller assembly 80 relative to the lift table 60 in accordance with the dimensions of the enclosure 88. Additionally, a latch 92 (FIG. 1) is provided for selectively locking the roller assembly 80 and lift table 60 against movement relative to each other when desired.

Figure 3:
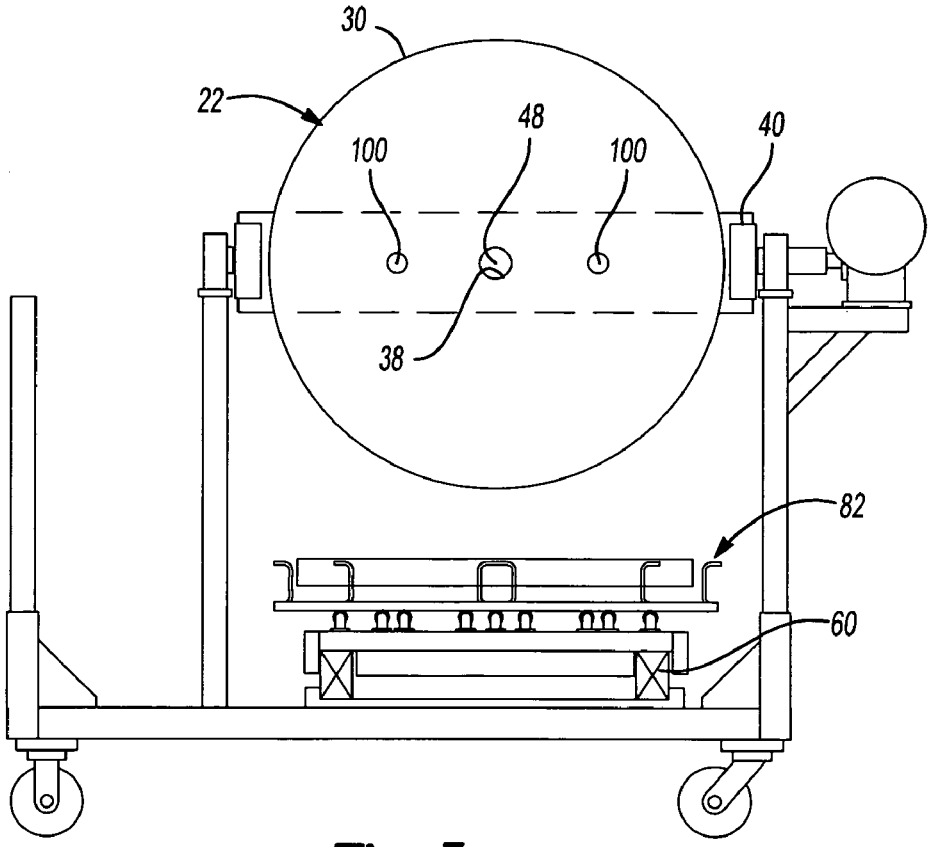
FIGS. 3–9 are all side diagrammatic views illustrating the operation of the preferred embodiment of the present invention.

The operation of the apparatus of the present invention will now be described. With reference first to FIG. 3, the lift table 60 is initially moved to its lowered position. Simultaneously, the support bar 40 is pivoted so that its locating pin 48 protrudes horizontally outwardly from the support bar 40.

The spent grinding wheel 22 with its attached mounting plate is then removed from the grinding machine in the conventional fashion. Thereafter, the grinding wheel 22 with its attached mounting plate is moved by a crane against the support bar 40 as shown in FIG. 3 and so that the locating pin 48 is positioned through the opening 38 in the mounting plate 30. The mounting plate 30 is then secured to the support bar 40 by fasteners 100 which extend through the openings 52 in the support bar 40 and threadably engage the threaded openings 39 (FIG. 9) in the mounting plate 30.

Figure 4:
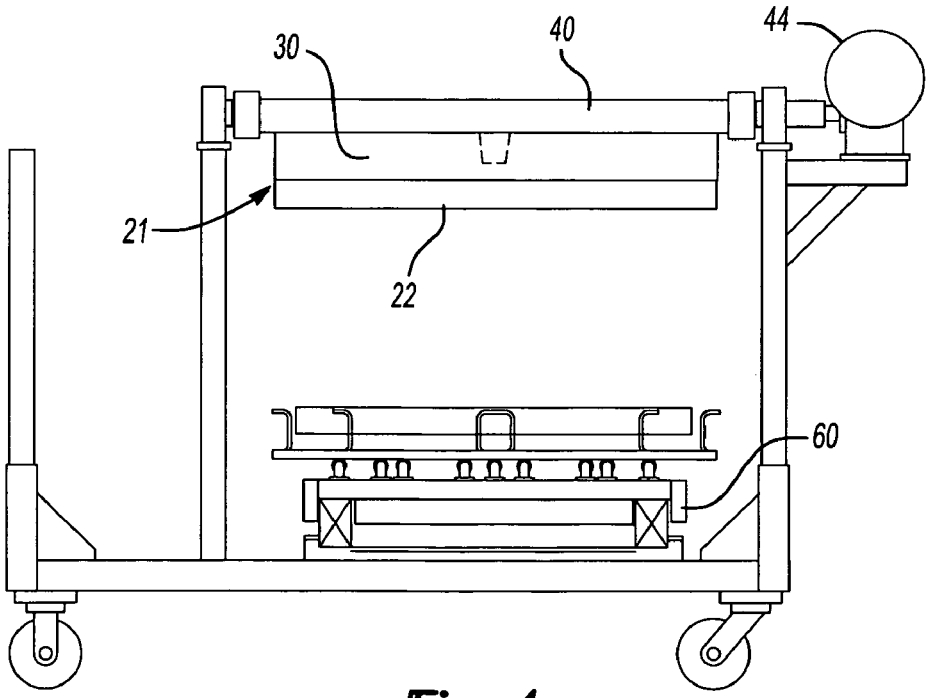

With reference now to FIG. 4, the support bar 40 is then pivoted about its longitudinal axis by the actuator 44 so that the grinding wheel 22 faces downwardly towards the lift table 60 and in a generally horizontal plane.

After the grinding wheel 22 has been positioned in a horizontal plane as shown in FIG. 4, the lift table 60 is actuated and moved from its lowered position, illustrated in FIG. 4, to its raised position, illustrated in FIG. 5. In its raised position, the rollers 84 abut against and support the lower surface of the grinding wheel 22. The spent grinding wheel 22 is then detached from its mounting plate 30 by unscrewing the fasteners 32 (FIG. 9) from the grinding wheel 22.

After the grinding wheel 22 has been completely disconnected from its mounting plate 30, the lift table 60 is again actuated to move it from its raised and to its lowered position as shown in FIG. 6. In doing so, the spent grinding wheel 22 is supported by the roller assembly 80 while the mounting plate 30 remains attached to the support bar 40. The spent grinding wheel 22 is then removed from the roller assembly 80 and disposed of in the conventional fashion.

Figure 7:
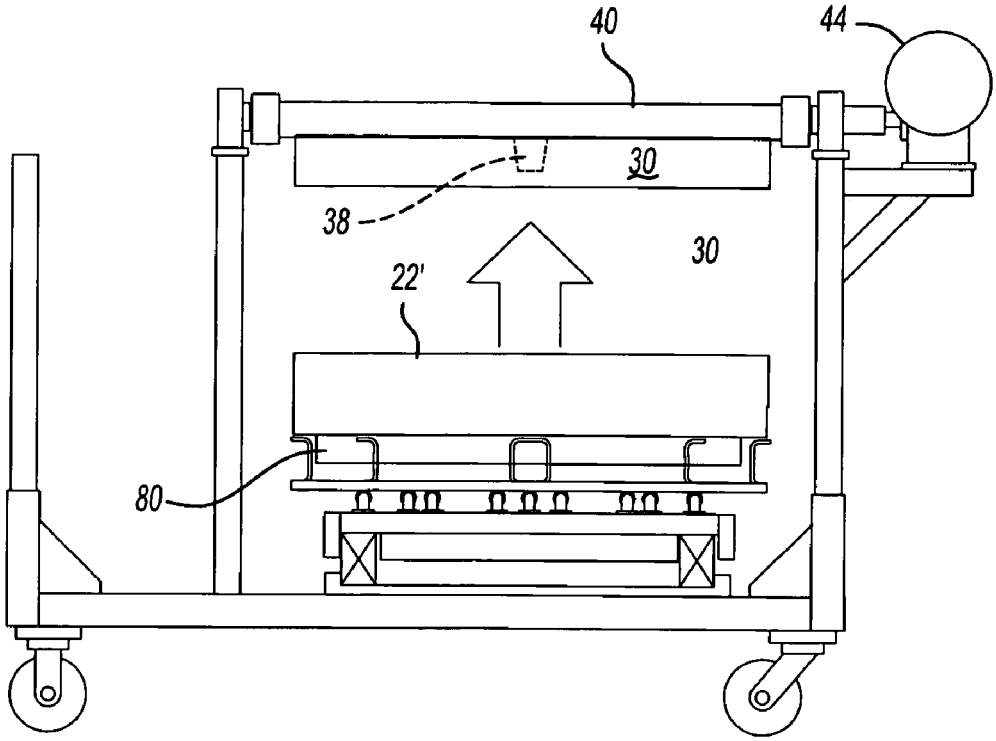

With reference now to FIG. 7, a new grinding wheel 22' is then positioned on the roller assembly 80 so that the center of the new grinding wheel 22' is substantially aligned with the locating pin 38.

Figure 8:
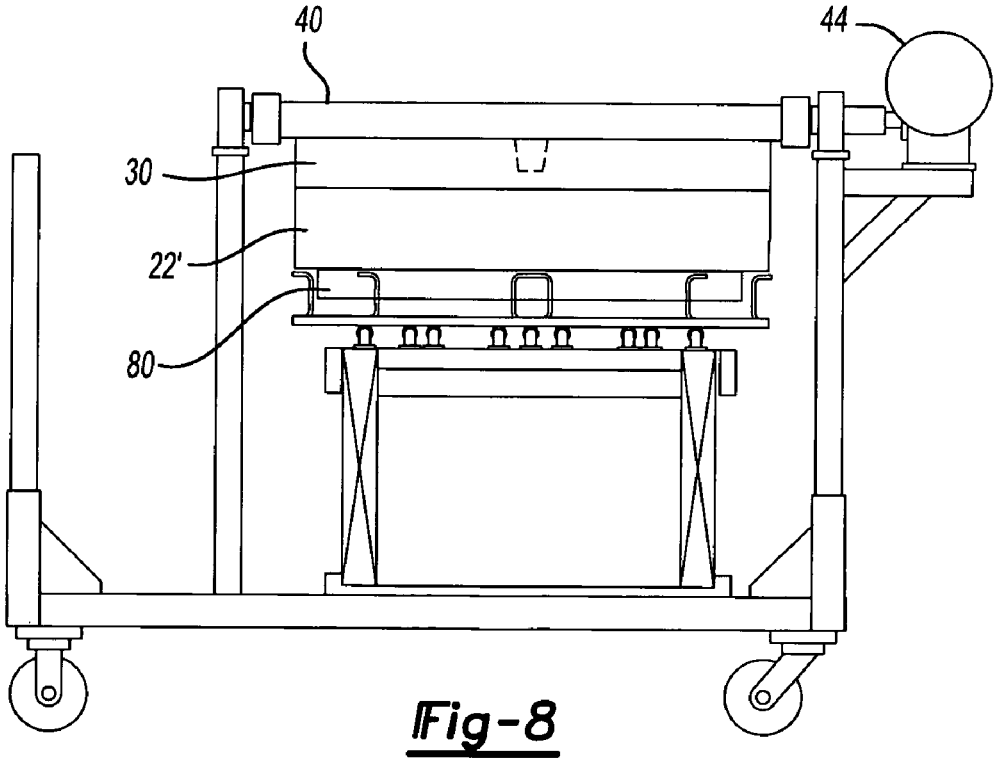

The lift table 60 is then actuated to move the lift table 60, the roller assembly 22, and the new grinding wheel 22' to the raised position as shown in FIG. 8 so that the new grinding wheel 22' flatly abuts against the mounting plate 30. The new grinding wheel 22' is then manually positioned by moving the roller assembly 80 relative to the lift table 60 so that the mounting holes in the mounting plate 30 register with the embedded nuts glued into the new grinding wheel 22'. When properly aligned, the new grinding wheel 22' is secured to the mounting plate 30 using conventional threaded fasteners 32.

Figure 9:
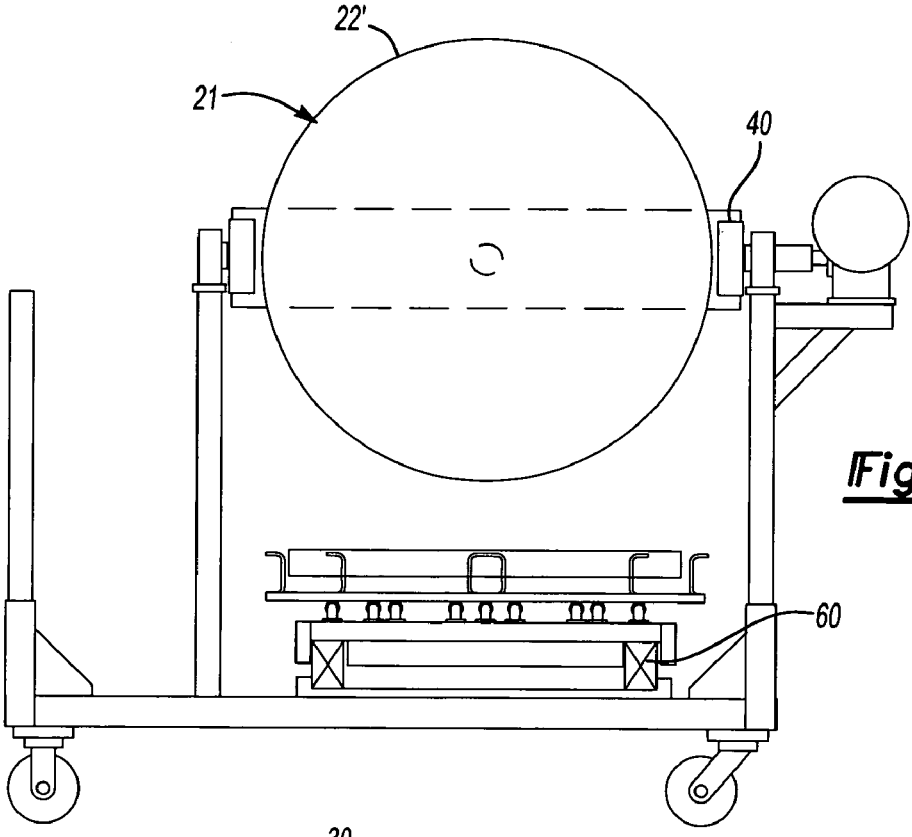

With reference now to FIG. 9, after the new grinding wheel 22' is secured to the mounting plate 30, the lift table 60 is again moved to its lowered position and the support bar 40 pivoted so that the new grinding wheel 22' lies in substantially a vertical plane. The grinding wheel 22' with its attached mounting plate 30 is then secured to a crane or other lifting device in the conventional fashion and the mounting plate 30 disconnected from the support bar 40 by unscrewing the fasteners holding the mounting plate 30 to the support bar 40. The new grinding wheel 22' is then attached to the rotary drive mechanism for the grinding machine (not shown) in the conventional fashion.

Although the apparatus of the present invention has been described as changing a single grinding wheel 22 on a single mounting plate 30, it will be understood that optionally a second grinding wheel may be supported by the roller assembly 80.

From the foregoing, it can be seen that the present invention provides a simple and yet efficient apparatus for facilitating the replacement of a grinding wheel for an industrial grinding machine. Having described my invention, however, many modifications thereto will become apparent to those skilled in the art to which it pertains without deviation from the spirit of the invention as defined by the scope of the appended claims.

I claim:

1. Apparatus to facilitate replacement of a grinding wheel on a mounting plate comprising:

a frame having two-spaced apart uprights, an elongated support bar extending between and pivotally mounted to said uprights, a mounting plate of a grinding wheel being detachably secured to said support bar, a lift table mounted to said frame between said uprights, said lift table being movable between a raised position in which said lift table is positioned adjacent said support bar and a lowered position in which said lift table is spaced downwardly from said support bar, said lift table being dimensioned to support a grinding wheel, an actuator which selectively moves said lift table between said raised and said lowered positions.

2. The invention as defined in claim 1 and comprising a roller assembly positioned on an upper surface of said lift table, the grinding wheel being positionable on said roller assembly.

3. The invention as defined in claim 2 wherein said roller assembly comprises a roller frame and a plurality of cylindrical rollers rotatably mounted to said roller frame.

4. The invention as defined in claim 3 and comprising at least one bearing disposed between said lift table and said roller frame, said at least one bearing enabling at least limited movement of said roller frame relative to said lift table about a horizontal plane.

5. The invention as defined in claim 4 wherein said at least one bearing comprises a plurality of spaced bearings.

6. The invention as defined in claim 5 wherein each bearing comprises a ball bearing.

7. The invention as defined in claim 4 and comprising means form limiting the magnitude of movement in said horizontal plane of said roller frame relative to said lift table.

8. The invention as defined in claim 7 wherein said limiting means comprises a pin secured to and extending downwardly from said roller frame, said pin being positioned in an opening in said lift table.

9. The invention as defined in claim 1 wherein said lift table comprises a scissor lift table.

10. The invention as defined in claim 9 and comprising a shaft mounted to said scissor lift table so that rotation of said shaft in one direction moves said lift table from said lowered position and toward said raised position and vice versa.

11. The invention as defined in claim 10 and comprising a gear box having an input member and an output member operatively coupled to said shaft.

12. The invention as defined in claim 11 and comprising a motor drivingly connected to said shaft.

13. The invention as defined in claim 12 wherein said motor comprises a pneumatic motor.

14. The invention as defined in claim 12 wherein said motor comprises an electric motor.

15. The invention as defined in claim 1 and comprising a plurality of wheels secured to said frame to facilitate movement of said frame on a ground support surface.

16. The invention as defined in claim 1 wherein the mounting plate includes a central opening and comprising an alignment pin mounted to said support bar and dimensioned to be insertable into the central opening of the mounting plate.

17. The invention as defined in claim 1 and comprising a gearbox having an output coupling operatively connected to said support bar, and a hand crank operatively connected to an input coupling of said gearbox.

18. The invention as defined in claim 1 wherein said frame comprises a storage area for at least one grinding wheel.

* * * * *